US005118316A

United States Patent [19]

Kakizaki et al.

[11] Patent Number: 5,118,316

[45] Date of Patent: Jun. 2, 1992

[54] EXHAUST SYSTEM FOR MARINE PROPULSION UNIT

[75] Inventors: Toshihiro Kakizaki; Satoshi Watanabe; Ryoichi Yamaoka, all of Hamamatsu, Japan

[73] Assignee: Sanshin Kogyo Kabushiki Kaisha, Hamamatsu, Japan

[21] Appl. No.: 575,969

[22] Filed: Aug. 31, 1990

[30] Foreign Application Priority Data

Sep. 1, 1989 [JP] Japan ..... 1-224551

[51] Int. Cl.[5] ..... B63H 21/32

[52] U.S. Cl. ..... 440/89

[58] Field of Search ..... 440/88, 89; 60/272, 60/324; 181/235, 237

[56] References Cited

U.S. PATENT DOCUMENTS

| | | | |
|---|---|---|---|
| 3,310,022 | 3/1967 | Kollman | 440/89 |
| 4,518,363 | 5/1985 | Bland et al. | 440/89 |
| 4,601,666 | 7/1986 | Wood | 440/89 |
| 4,897,061 | 1/1990 | Koepsel et al. | 440/89 |
| 4,986,783 | 1/1991 | Brown | 440/900 |
| 5,037,340 | 8/1991 | Kaisha | 440/88 |

FOREIGN PATENT DOCUMENTS 56-57916 5/1981 Japan .

*Primary Examiner*—Jesûs D. Sotelo
*Assistant Examiner*—Stephen P. Avila
*Attorney, Agent, or Firm*—Ernest A. Beutler

[57] ABSTRACT

An exhaust and lubricating system for an outboard motor wherein the outboard motor is provided with an underwater high speed exhaust gas discharge and an above the water low speed exhaust gas discharge. A duck bill type of check valve is provided in the above the water exhaust gas discharge for precluding water from being drawn into the expansion chamber. The engine has a lubricating system with a lubricant reservoir that surrounds the exhaust pipe and is formed integrally with the exhaust pipe. Interconnecting ribs connect the exhaust pipe to the lubricant reservoir and lubricant is returned to the reservoir so that it contacts the wall of the reservoir where the ribs are joined for additional cooling.

11 Claims, 5 Drawing Sheets

EXHAUST SYSTEM FOR MARINE PROPULSION UNIT

BACKGROUND OF THE INVENTION

This invention relates to an exhaust system for a marine propulsion unit and more particularly to an improved low speed exhaust gas discharge for such a unit and also to an arrangement for insuring cooling of the exhaust gases without heating the other fluids of the engine adversely.

It is well known in marine engines to silence the exhaust gases emanating from the engine, be at either an inboard or an outboard mounted engine, by passing them through the body of water in which the watercraft is operated. This is normally accomplished by a form of underwater exhaust gas discharge, such as those that discharge the exhaust gases through the hub of the propeller. However, when the watercraft is operating at a low speed, the underwater exhaust gas discharge will become relatively deeply submerged and this coupled with the relatively low exhaust gas pressure can give rise to high back pressure in the exhaust system. For that reason, it is the normal practice to employ a further, low speed, above the water exhaust gas discharge for discharging the exhaust gases directly to the atmosphere without flowing through the body of water in which the watercraft is operating under this running condition.

Normally the above water exhaust gas discharge is generally open under all conditions and the flow path to it is provided with restrictions so as to ensure against excess noise when operating under high speed conditions. However, there are times when the exhaust pressure may, in the exhaust system, become negative. This means that air and entrained water may enter the exhaust system through the exposed above the water exhaust gas discharge. The problems attendant with such a result should be obvious.

It is, therefore, a principal object of this invention to provide an improved above the water exhaust gas discharge system for a marine engine wherein water entry into the exhaust system will be precluded.

In conjunction with some forms of marine engines such as outboard motors, a four cycle internal combustion engine is employed which has a lubricant reservoir that depends into the drive shaft housing of the outboard motor. Also, the drive shaft housing is employed as an expansion chamber for silencing of the exhaust gases. In order to permit a compact arrangement it has been the practice to surround at least a portion of the exhaust system with the oil reservoir. However, in order to preclude against undue heating of the lubricant in the oil reservoir it has been the practice to provide a cooling jacket between the exhaust pipe exterior and the interior of the surrounding lubricant reservoir. However, for strength and manufacturing purposes it is desirable to provide some mechanical interconnection between the exhaust pipe and the interior of the lubricant reservoir, such as interconnecting ribs. These ribs obviously will transmit heat from the exhaust pipe to the lubricant reservoir.

It is, therefore, a still further object of this invention to provide an improved lubricant reservoir and exhaust pipe system wherein the exhaust pipe can be supported by the lubricant reservoir but wherein the exhaust pipe heat will not be transmitted significantly to the lubricant in the lubricant reservoir.

SUMMARY OF THE INVENTION

A first feature of this invention is adapted to be embodied in an exhaust system for a marine engine having an exhaust port and a high speed underwater discharge for discharging exhaust gases to the atmosphere through a body of water in which the associated watercraft is operating. An above the water exhaust gas discharge is also provided for discharging exhaust gases from the exhaust port directly to the atmosphere without flowing through the body of water. Check valve means are provided for permitting exhaust gases to exit from the above the water exhaust gas discharge while precluding the flow of water from the atmosphere to the exhaust port through the above the water exhaust gas discharge.

Another feature of the invention is adapted to be embodied in an outboard motor having a power head with a powering internal combustion engine having an exhaust system and a lubricating system. A drive shaft housing depends from the power head and defines an expansion chamber to which exhaust gases are delivered from the engine exhaust system through an exhaust pipe. A lubricant reservoir is also provided within the drive shaft housing in surrounding relationship to the exhaust pipe. Means are provided for returning lubricant to the lubricant reservoir from the engine. The exhaust pipe has interconnecting members that bridge it and the internal surface of the lubricant reservoir. The return means for returning lubricant from the engine to the lubricant reservoir directs the lubricant across the portion of the lubricant reservoir in contact with these means for cooling the lubricant reservoir.

DETAILED DESCRIPTION OF THE PREFERRED EMBODIMENT

Figure 1:
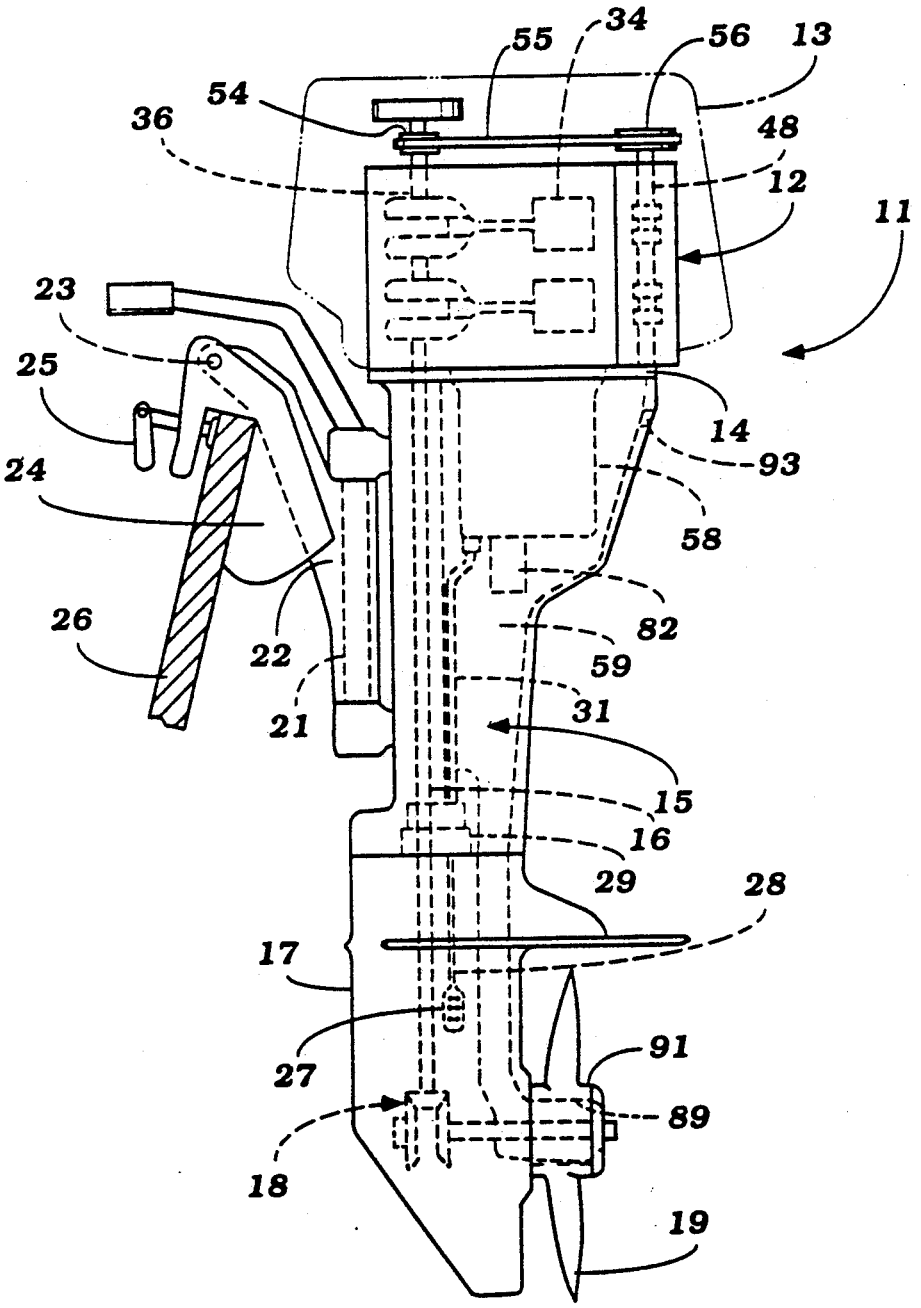
FIG. 1 is a side elevational view of an outboard motor constructed in accordance with an embodiment of the invention as attached to the transom of an associated watercraft, shown partially and in cross-section.

Referring first to FIG. 1, an outboard motor constructed in accordance with an embodiment of the invention as identified generally by the reference numeral 11. The invention is described in conjunction with an outboard motor but it is to be understood that certain facets of the invention may be employed in conjunction with inboard mounted marine engines. The outboard motor 11 includes a power head comprised of an internal combustion engine, indicated generally by the reference numeral 12 which, in the illustrated embodiment is of the two cylinder in-line four cycle type. It is to be understood, of course, that the invention can be practiced in conjunction with engines having other cylinder numbers or other cylinder configurations. Certain features of the invention, however, have particular utility in conjunction with four cycle engines or engines having lubricant systems that employ separate lubricant reservoirs.

A protective cowling, shown in phantom and identified by the reference numeral 13 encircles the engine 12. The engine 12 is mounted on a spacer plate 14 which, in turn, couples the power head to a drive shaft housing, indicated generally by the reference numeral 15. A drive shaft 16 is coupled to the engine output shaft and depend into the drive shaft housing 15 where it is journaled in an appropriate manner. This drive shaft 16 continues into a lower unit 17 where it drives a forward neutral reverse transmission 18 of a known type for driving a propeller 19 in selected forward and reverse directions.

A steering shaft 21 is affixed to the drive shaft housing 15 and is journaled within a swivel bracket 22 for steering of the outboard motor 11 about a generally vertically extending axis. The swivel bracket 22 is connected for pivotal movement by a pivot pin 23 to a clamping bracket 24 for tilt and trim movement of the outboard motor 11. The clamping bracket 24 carries a clamping device 25 for affixing the outboard motor 11 to a transom 26 of a watercraft in a known manner.

The engine 12 is water cooled and cooling water for the engine cooling system is drawn through an underwater inlet 27 formed in the lower unit 17 through a conduit 28. A coolant pump 29 is supported on the upper end of the lower unit 17 within the lower end of the drive shaft housing 15 and is driven by the drive shaft 16 for drawing water from the body of water in which the watercraft is operating and delivering it to the engine cooling system through a conduit 31.

Figure 2:
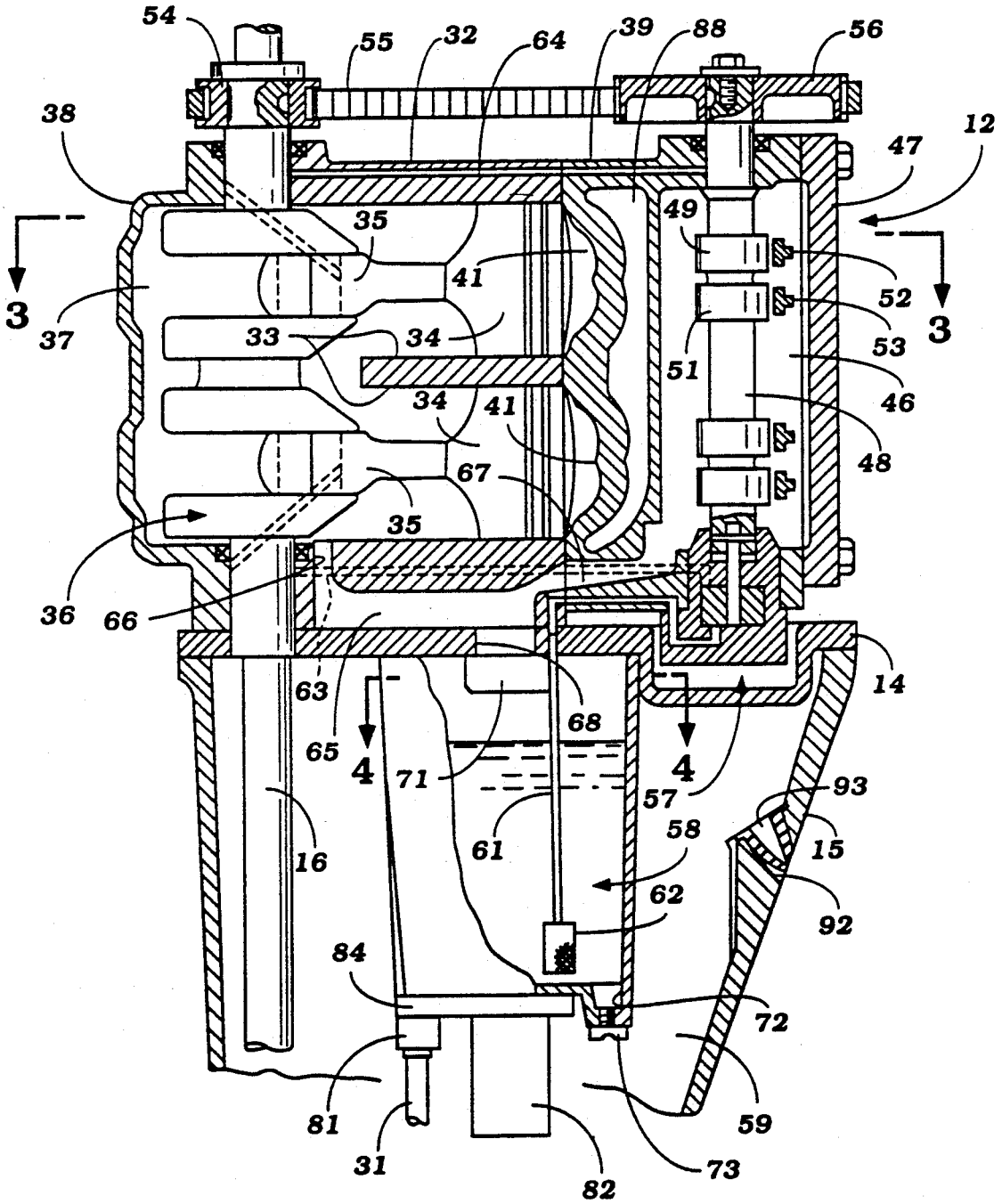
FIG. 2 is an enlarged cross-sectional view taken through the engine of the power head and the upper portion of the drive shaft housing.
Figure 3:
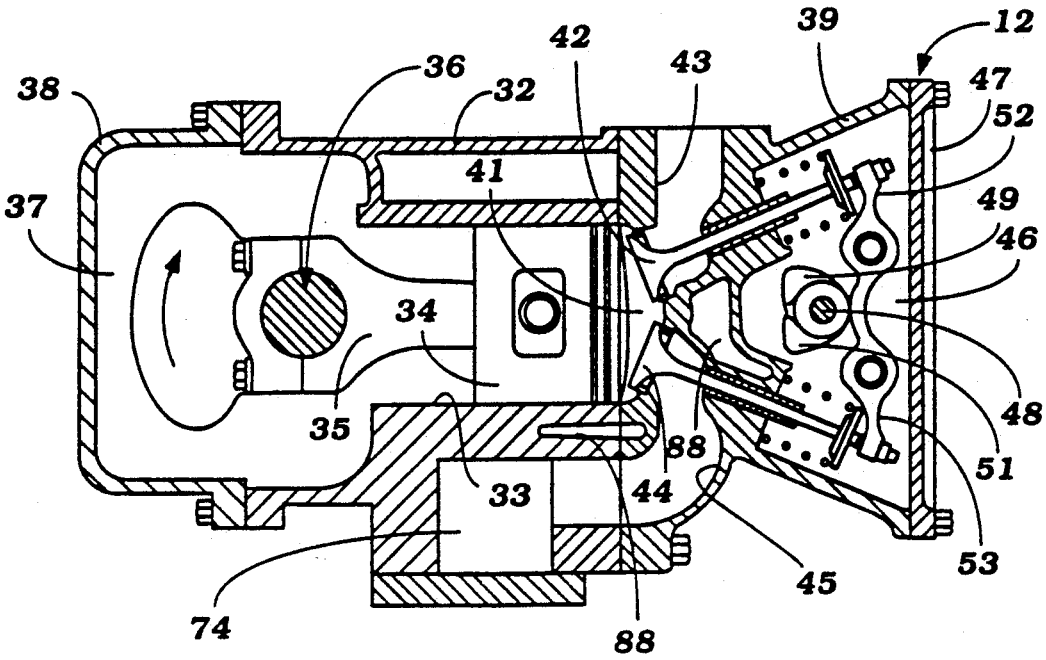
FIG. 3 is a cross-sectional view taken along the line 3—3 of FIG. 2.
Figure 4:
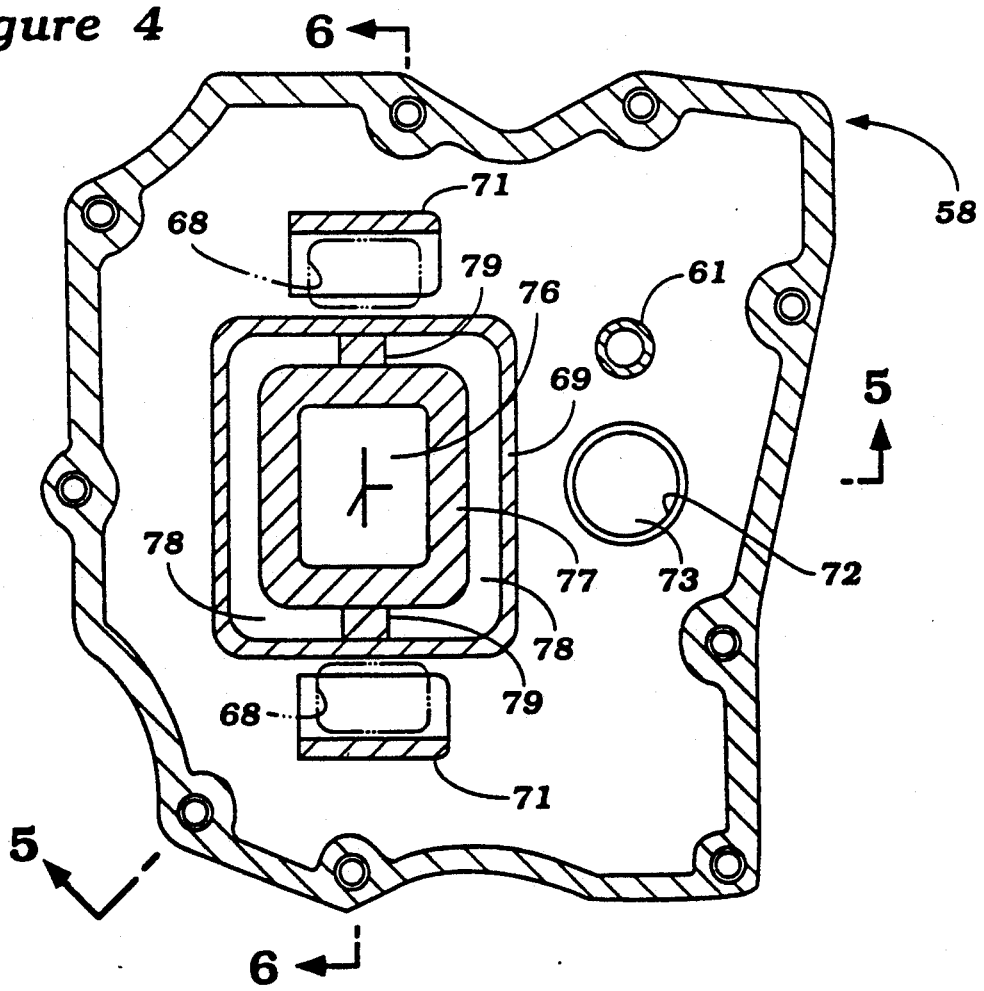
FIG. 4 is a further enlarged cross-sectional view taken along the line 4—4 of FIG. 2.

Referring now in detail primarily to FIGS. 2 and 3, the engine 12 includes a cylinder block 32 in which two horizontally disposed cylinder bores 33 are formed. Pistons 34 reciprocate in the cylinder bores 33 and are connected by means of connecting rods 35 to the throws of a crankshaft 36. The crankshaft 36 is journaled within a crankcase chamber 37 in an appropriate manner by means including bearings formed by the cylinder block 32 and a crankcase member 38 that is affixed to the cylinder block 32 in a known manner.

A cylinder head 39 is affixed to the cylinder block 32 at the end opposite the crankcase 38. The cylinder head 39 has recesses 41 which cooperate with the cylinder bores 33 and pistons 34 to form the combustion chambers of the engine. Intake valves 42 are supported within the cylinder head 39 and cooperate with valve seats formed at the exit end of intake passages 43 that extend through one side of the cylinder head. A charge is delivered to the intake passages 43 by a suitable charge forming system (not shown).

In a similar manner, exhaust valves 44 are also supported within the cylinder head 39 and cooperate with valve seats formed at the base of exhaust passages 45 for controlling the exit of the exhaust gases from the combustion chambers 41.

The intake and exhaust valves 42 and 44 are operated by means of an operating mechanism supported within a cam chamber 46 formed at the upper end of the cylinder head 39 and closed by a cam cover 47. A single overhead mounted camshaft 48 is journaled with the cam chamber 46 and has lobes 49 and 51 which operate rocker arms 52 and 53, respectively, for opening and closing the valves 42 and 44.

A timing sprocket 54 is affixed to the upper end of the crankshaft 36 and drives a toothed belt 55. The tooth belt 55, in turn, drives a driven sprocket 56 that is affixed to the camshaft 48 for driving the camshaft 48 at one half crankshaft speed.

The engine 12 has a lubricating system that includes a lubricant pump 57 that is driven off the lower end of the camshaft 48 and which is of the trochoidal type. This lubricant pump 57 draws lubricant from a lubricant reservoir, indicated generally by the reference numeral 58, which depends into the drive shaft housing 15 and specifically into a large expansion cavity 59 formed therein. The lubricant reservoir 58 has a construction which will be described later by reference to the remaining figures.

A conduit 61 draws lubricant from the reservoir 58 through a filter 62 and delivers it to the pump 57. This lubricant is then delivered through a main delivery gallery 63 formed in the cylinder head 39 and cylinder block 32 for lubricating the main and connecting rod bearings of the crankshaft 38. A further delivery gallery 64 extends across the upper end of the cylinder block 32 and cylinder head 39 and supplies lubricant to the camshaft 48 and rocker arms. The lubricant which has been circulated through the engine is then returned to a drain cavity 65 formed in the lower face of the cylinder block 32 from a crankcase drain 66 and a cylinder head drain 67. The spacer plate 14 is formed with a pair of return passages 68 which extend adjacent a generally rectangular cross-section inner wall 69 of the lubricant reservoir 58. Baffle plates 71 are formed on the plate 14 beneath these drain openings 68 so as to direct the returning lubricant against the side walls of the portion 69 for a reason to be described.

The lower end of the lubricant reservoir 58 is formed with a well 72 and closure plug 73 so as to facilitate draining and replacement of the lubricant for the engine.

Figure 6:
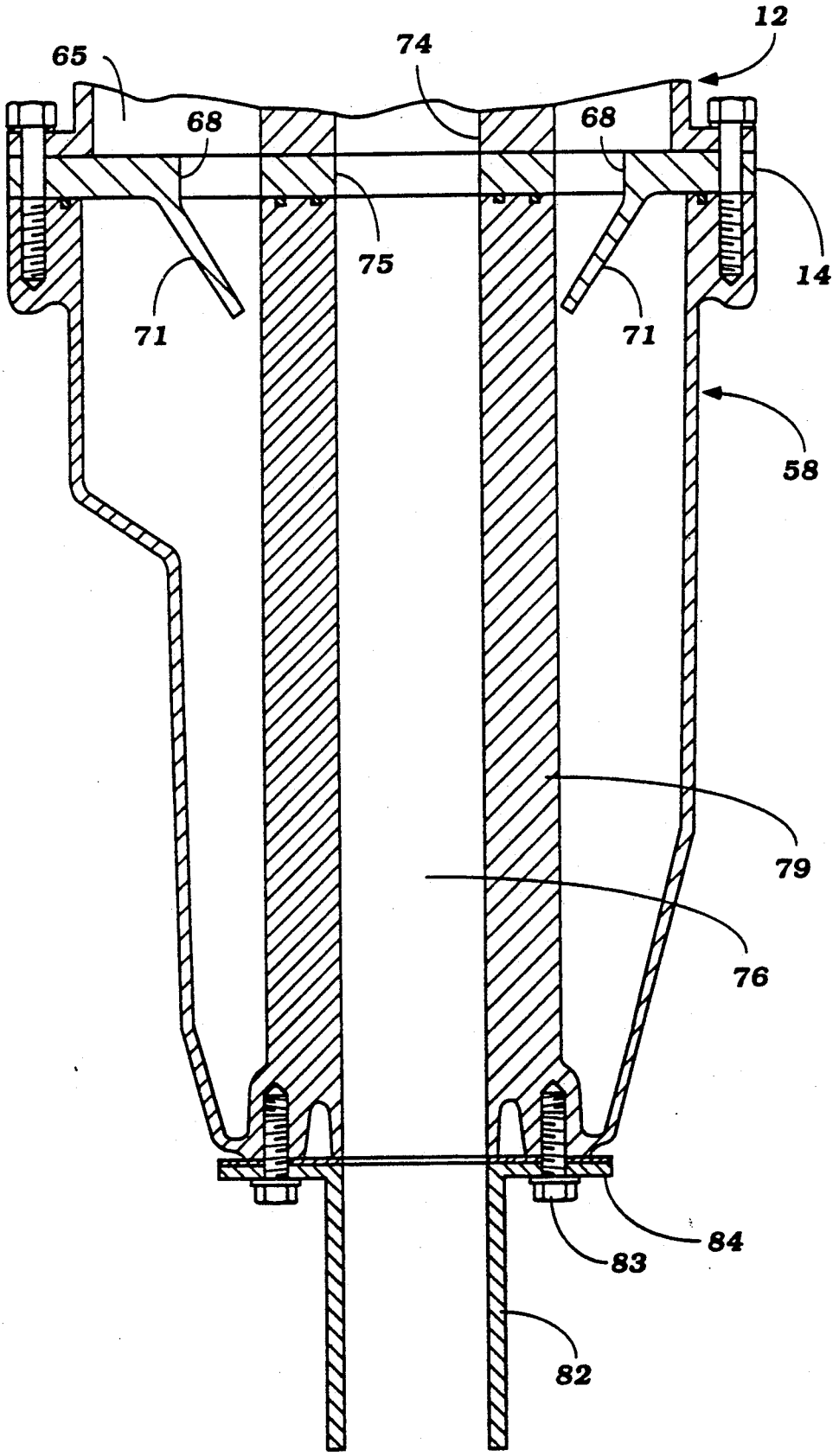
FIG. 6 is a cross-sectional view taken along the line 6—6 of FIG. 4.

Referring again to FIG. 3, it will be noted that the cylinder head exhaust passages 45 communicate with a vertically extending exhaust manifold 74 that is formed in the cylinder block at one side thereof. This exhaust manifold 74 communicates with a corresponding exhaust passageway 75 (FIG. 6) formed in the spacer plate 14 which, in turn, communicates with an exhaust pipe 76 having an outer surface 77 that is spaced inwardly from the lubricant reservoir inner wall 69. A resulting coolant jacket 78 is formed therebetween. It should be noted that lubricant reservoir and exhaust pipe 76 may be conveniently formed as a single piece and to this end there are connecting ribs 79 that extend between opposite sides of the exhaust pipe 76 and the inner wall 69 of the lubricant is directed by the baffle plates 71 so as to insure adequate cooling and to insure against overheating of the lubricant.

Figure 5:
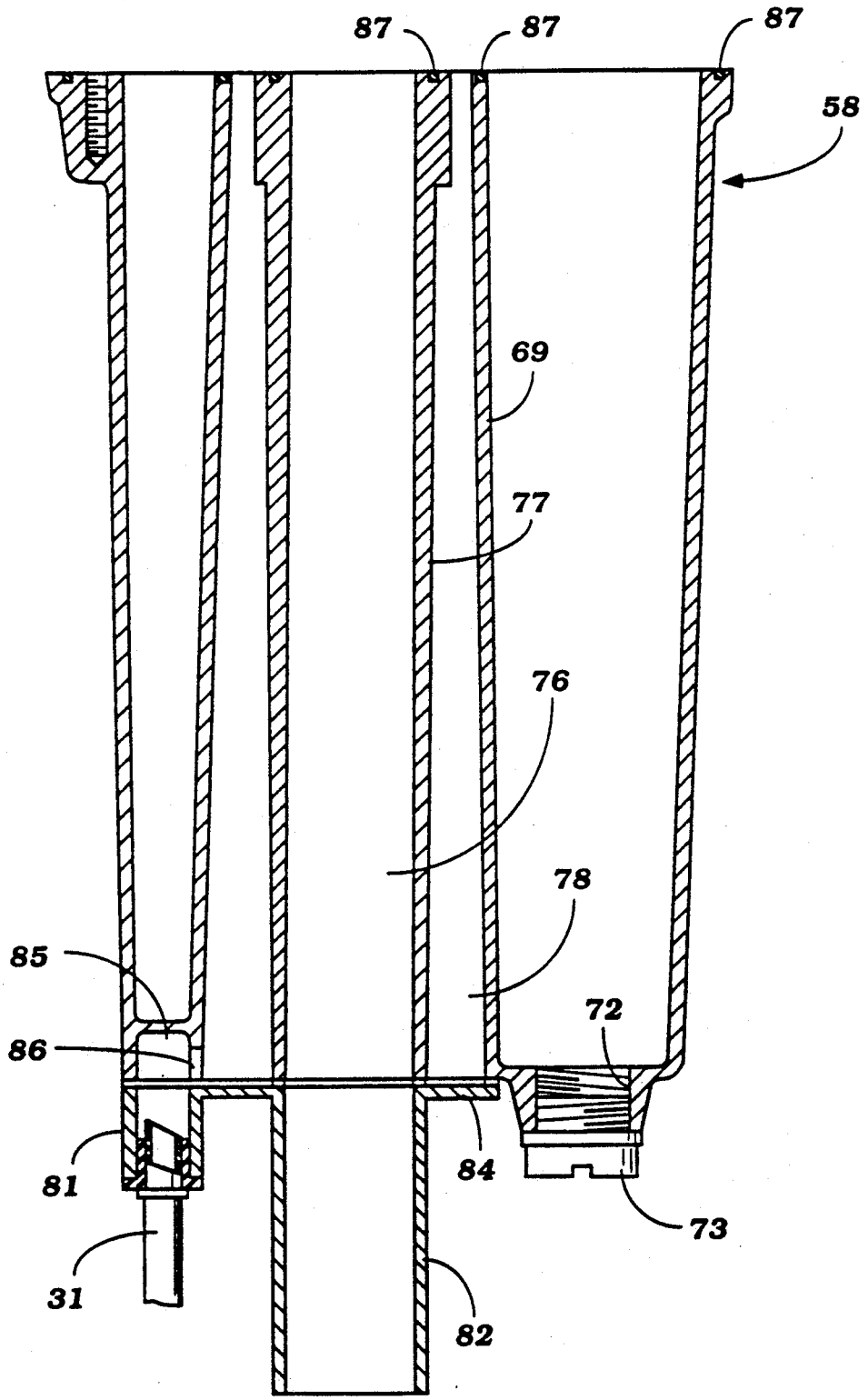
FIG. 5 is a cross-sectional view taken along the line 5—5 of FIG. 4.

As may be seen from FIGS. 2 and 5, the coolant delivery line 31 extends to a fitting 81 formed in an exhaust pipe extension 82 that is affixed to the lower end of the oil reservoir 58 by threaded fasteners 83 that pass through a flange 84 of the extension 82. This coolant then flows into a small cavity 85 formed at the lower end of the oil reservoir 58 and through a transverse passageway 86 to the cooling jacket 78 for the cooling the exhaust pipe. This water then flows upwardly, being sealed by gaskets 87 formed at the upper end of the reservoir 58 and engaging the spacer plate 14 to enter the cooling jacket of the engine 12. This cooling jacket is shown partially in FIGS. 2 and 3 and is identified by the reference numeral 88.

It should be readily apparent that the exhaust gases from the engine 12 and specifically its manifold 74 will flow down the exhaust pipe 76 and its extension 82 and enter the expansion chamber 59. This expansion of the exhaust gas achieves a silencing affect. The exhaust gases are then discharged, under high speed running operation, through the hub exhaust passage 89 formed in the hub 91 of the propeller 19. However, the efficiency of the underwater exhaust opening 89 is good only when the associated watercraft is travelling at high speeds. At lower speeds, the degree of submersion and the relatively low pressure of the exhaust gases due to the low running speed of the engine 12 will not be sufficient to permit the exhaust gases to exit through this opening. To accommodate this running condition, the drive shaft housing 15 is provided with an above the water low speed exhaust gas discharge 92. However, such low speed exhaust gas discharges, which are generally open, present the problem of water re-entry into the expansion chamber 59. In order to avoid that, a duck bill type check valve 93 is pressed into the opening 92. The check valve 93 is configured so as to permit exhaust gases to exit from the opening 92 but in the event there is a negative pressure in the expansion chamber 59, because of the venturi action around the propeller hub 91, at high speeds the valve 93 will close and water cannot be drawn in.

It should be readily apparent from the foregoing description that the described exhaust and lubricating system for the engine 12 permits a large lubricant capacity, effective exhaust silencing under all running conditions and precludes against entry of water into the drive shaft housing through the above the water exhaust gas discharge. Of course, the previously described embodiment is only a preferred form that the invention may take and various changes and modifications may be made without departing from the spirit and scope of the invention, as defined by the appended claims.

We claim:

1. An exhaust system for a marine engine having an exhaust port, a high speed underwater exhaust discharge for discharging exhuat gases to the atmosphere through the body of water in which an associated watercraft is operating, an above the water exhaust gas discharge for discharging exhaust gases from said exhaust port directly to the atmosphere without flowing through said body of water, and check valve means for permitting exhaust gases to exit from said above the water exhaust gas discharge while precluding the flow of water from the atmosphere to said exhaust port through said above the water exhaust ga discharge; and wherein the marine engine is a portion of an outboard motor, said outboard motor being provided with a drive shaft housing depending therefrom, said driveshaft housing having a wall, and wherein said check valve means is positioned through said wall; and further including an oil reservoir provided within the drive shaft housing of the marine engine; and wherein an intermediate region in between the check valve means and the oil reservoir contains no arrangement for preventing the movement of water from the check valve means towards, and the moving water's ultimate impingement upon, the oil reservoir.

2. An exhaust system as set forth in claim 1 wherein the above the water exhaust gas discharge is positioned externally of a hull and above the water.

3. An exhaust system as set forth in claim 1 wherein the check valve means comprises an elastomeric valve.

4. An exhaust system as set forth in claim 3 wherein the elastomeric valve comprises a duck bill type valve.

5. An exhaust system as set forth in claim 4 wherein the above the water exhaust gas discharge is positioned externally of a hull and above the water.

6. An exhaust system for a marine engine having an exhaust port, a high speed underwater exhuat discharge for discharging exhaust gases to the atmosphere through the body of water in which a associated watercraft is operating, an above the water exhaust gas discharge for discharging exhaust gases from said exhaust port directly to the atmosphere without flowing through said body of water and check valve means for permitting exhaust gases to exit from said above the water exhaust gas discharge while precluding the flow of water from the atmosphere to said exhaust port through said above the water exhaust gas discharge; and further including an oil reservoir and an expansion chamber, wherein the oil reservoir is positioned within the expansion chamber and exhaust gases are delivered from the exhaust port to the expansion chamber through a passage extending along a portion of the oil reservoir; and wherein said check valve means extends between the expansion chamber and the atmosphere, and wherein an intermediate region located in between the check valve means and the oil reservoir contains no arrangement for preventing the movement of water from the check valve means towards, and the moving water's ultimate impingement upon, the oil reservoir.

7. An exhuat system as set forth in claim 6 further including a lurid cooling jacket extending between the oil reservoir and an exhaust pipe.

8. An exhaust system as set forth in claim 7 wherein the oil reservoir and the exhaust pipe are integrally formed with each other and are connected by ribs that extend through the cooling jacket.

9. An exhaust system as set forth in claim 8 wherein lubricant is returned from the engine to the lubricant reservoir through a system that directs the returned lubricant flow against the portion of the lubricant reservoir to which the ribs are connected.

10. An outboard motor having a power head containing an internal combustion engine, a drive shaft housing depending from said power head and forming an expansion chamber, a lubricant reservoir formed within said drive shaft housing, an exhaust pipe formed centrally within said lubricant for delivering exhaust gases from said engine to said expansion chamber, a cooling jacket extending between said exhaust pipe and said lubricant reservoir for cooling said exhaust pipe, said lubricant reservoir and said exhaust pipe being formed from a unitary assembly with ribs extending through said cooling jacket and connecting said exhaust pipe to said lubricant reservoir, means for delivering lubricant from said engine to said lubricant reservoir in contact with the portion of said lubricant reservoir adjacent said ribs for cooling said ribs.

11. An outboard motor as set forth in claim 10 including baffle means for directing the lubricant flow from the lubricant return means to the wall of the lubricant reservoir.

* * * * *